US008361953B2

(12) United States Patent
Nagy et al.

(10) Patent No.: US 8,361,953 B2
(45) Date of Patent: Jan. 29, 2013

(54) RINSE AID COMPOSITIONS WITH IMPROVED CHARACTERISTICS

(75) Inventors: Andras Nagy, Chester, VA (US); Saiid Mohammed, Glen Allen, VA (US); Dennis Parrish, Sandston, VA (US); Georg Schick, Providence Forge, VA (US); Ingo Hamann, Chesterfield, VA (US)

(73) Assignee: Evonik Goldschmidt Corporation, Hopewell, VA (US)

( * ) Notice: Subject to any disclaimer, the term of this patent is extended or adjusted under 35 U.S.C. 154(b) by 514 days.

(21) Appl. No.: 12/068,622

(22) Filed: Feb. 8, 2008

(65) Prior Publication Data

US 2009/0203571 A1 Aug. 13, 2009

(51) Int. Cl.

| | |
|---|---|
| ***C11D 1/00*** | (2006.01) |
| ***C11D 3/20*** | (2006.01) |
| ***C11D 3/26*** | (2006.01) |
| ***C11D 3/43*** | (2006.01) |

(52) U.S. Cl. ..... 510/525; 510/241; 510/242; 510/245; 510/259; 510/417; 510/504; 510/505; 510/506; 510/522

(58) Field of Classification Search ..... 510/241, 510/242, 417, 504, 505, 506, 245, 259, 522, 510/525

See application file for complete search history.

(56) References Cited

U.S. PATENT DOCUMENTS

| | | | | |
|---|---|---|---|---|
| 4,234,627 | A | 11/1980 | Schilling | |
| 4,514,461 | A | 4/1985 | Woo | |
| 4,747,880 | A * | 5/1988 | Berrido et al. | 106/205.8 |
| RE32,713 | E | 7/1988 | Woo | |
| 4,789,491 | A | 12/1988 | Chang et al. | |
| 4,882,220 | A | 11/1989 | Ono et al. | |
| 4,917,920 | A | 4/1990 | Ono et al. | |
| 5,137,646 | A | 8/1992 | Schmidt et al. | |
| 5,391,325 | A | 2/1995 | Swenson | |
| 5,480,567 | A | 1/1996 | Lam et al. | |
| 5,703,029 | A | 12/1997 | Crass | |
| 5,759,990 | A | 6/1998 | Wahl et al. | |
| 5,792,219 | A | 8/1998 | Hartman et al. | |
| 5,827,451 | A | 10/1998 | Cummings | |
| 6,180,593 | B1 | 1/2001 | Fender et al. | |
| 6,200,949 | B1 | 3/2001 | Reijimer et al. | |
| 6,235,914 | B1 | 5/2001 | Steiger | |
| 6,255,274 | B1 | 7/2001 | Becherer | |
| 6,376,455 | B1 | 4/2002 | Friedli | |
| 6,458,343 | B1 | 10/2002 | Zeman | |
| 6,492,322 | B1 | 12/2002 | Cooper et al. | |
| 6,608,024 | B1 | 8/2003 | DuVal et al. | |
| 6,645,479 | B1 | 11/2003 | Shefer et al. | |
| 6,653,275 | B1 | 11/2003 | Fender et al. | |
| 6,770,608 | B2 | 8/2004 | Franklin et al. | |
| 6,897,194 | B2 | 5/2005 | Fan et al. | |
| 6,987,074 | B2 * | 1/2006 | Ishii et al. | 442/59 |
| 7,572,761 | B2 | 8/2009 | Gefvert | |
| 7,704,940 | B2 | 4/2010 | Boerefijin et al. | |
| 7,994,110 | B2 | 8/2011 | Wenk et al. | |
| 8,183,199 | B2 | 5/2012 | Fossum et al. | |
| 2003/0060390 | A1 | 3/2003 | Demeyere et al. | |
| 2003/0158344 | A1 | 8/2003 | Rodrigues et al. | |
| 2003/0165692 | A1 | 9/2003 | Koch et al. | |
| 2003/0195130 | A1 | 10/2003 | Lentsch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216282 | A1 | 11/2003 | Martens et al. | |
| 2003/0216488 | A1 | 11/2003 | Uchiyama et al. | |
| 2003/0220210 | A1 | 11/2003 | DuVal et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0167056 | A1 | 8/2004 | Lentsch et al. | |
| 2004/0204337 | A1 | 10/2004 | Corona et al. | |
| 2005/0014672 | A1 | 1/2005 | Arif | |
| 2005/0032671 | A1 * | 2/2005 | Kvita et al. | 510/515 |
| 2006/0089293 | A1 | 4/2006 | Frankenbach | |
| 2006/0094639 | A1 | 5/2006 | Martin et al. | |
| 2006/0142175 | A1 * | 6/2006 | Haiss et al. | 510/515 |
| 2006/0277689 | A1 | 12/2006 | Hubig et al. | |
| 2007/0054835 | A1 | 3/2007 | Corona, III et al. | |
| 2007/0066510 | A1 | 3/2007 | Tee et al. | |
| 2007/0219111 | A1 | 9/2007 | Ward et al. | |
| 2008/0242584 | A1 | 10/2008 | Wahl et al. | |
| 2008/0263780 | A1 | 10/2008 | Declercq et al. | |
| 2008/0289116 | A1 | 11/2008 | Young et al. | |
| 2009/0124533 | A1 | 5/2009 | Kottke et al. | |
| 2009/0181877 | A1 | 7/2009 | McGinnis et al. | |
| 2011/0110993 | A1 | 5/2011 | Chieffi et al. | |
| 2011/0239377 | A1 | 10/2011 | Fossum et al. | |
| 2011/0239378 | A1 | 10/2011 | Fossum et al. | |
| 2011/0245138 | A1 | 10/2011 | Köhle et al. | |
| 2011/0245139 | A1 | 10/2011 | Köhle et al. | |
| 2011/0245140 | A1 | 10/2011 | Demeyere | |
| 2012/0088712 | A1 | 4/2012 | Schick et al. | |

FOREIGN PATENT DOCUMENTS

| | | |
|---|---|---|
| CA | 1312619 | 1/1993 |
| CS | 246532 | 3/1986 |

(Continued)

OTHER PUBLICATIONS

International Search Report for PCT/US2009/000727 filed Feb. 5, 2009. Written Opinion of the Internatonal Searching Authority for PCT/US2009/000727 filed Feb. 5, 2009.

International application PCT/US2009/000727 as published on Aug. 13, 2009 (with original claims 1-23).

Article 34 amendments and arguments filed for international application PCT/US2009/000727 on Dec. 7, 2009 (with amended claims 1-20).

Notification from the International Preliminary Examining Authority for PCT/US2009/000727 mailed Feb. 18, 2010.

Further claim amendments and arguments for PCT/US2009/000727 filed on Mar. 1, 2010.

(Continued)

*Primary Examiner* — Gregory Delcotto

(74) *Attorney, Agent, or Firm* — Law Office of: Michael A. Sanzo, LLC

(57) ABSTRACT

The present invention is directed to rinse aid compositions with improved biodegradability that may be used in automated carwash operations to promote drying and improve the appearance of vehicles.

14 Claims, No Drawings

FOREIGN PATENT DOCUMENTS

| | | | |
|---|---|---|---|
| DE | 24 30 140 | A1 | 2/1976 |
| DE | 34 02 146 | A1 | 7/1985 |
| DE | 36 08 093 | A1 | 9/1987 |
| DE | 197 08 133 | | 12/1997 |
| EP | 0 284 036 | | 9/1988 |
| EP | 0 293 955 | A2 | 12/1988 |
| EP | 0 302 567 | A2 | 2/1989 |
| EP | 0 421 146 | A2 | 9/1990 |
| EP | 0 829 531 | A1 | 3/1998 |
| EP | 1 018 541 | A1 | 7/2000 |
| EP | 1 323 817 | A1 | 12/2001 |
| EP | 1 393 706 | A1 | 3/2004 |
| EP | 1 840 197 | A1 | 2/2007 |
| GB | 2 007 734 | A | 5/1979 |
| GB | 2 039 556 | | 8/1980 |
| WO | WO 91/01295 | | 2/1991 |
| WO | WO 92/18593 | | 10/1992 |
| WO | WO 94/14935 | | 7/1994 |
| WO | WO 94/19439 | | 9/1994 |
| WO | WO 98/38277 | | 9/1998 |
| WO | WO 00/06678 | | 2/2000 |
| WO | WO 2005/085404 | A1 | 9/2005 |
| WO | WO 2007/026314 | A2 | 3/2007 |
| WO | WO 2007/125005 | | 11/2007 |
| WO | WO 2008/104509 | | 9/2008 |
| WO | WO 2009/018955 | A2 | 2/2009 |
| WO | WO 2011/120836 | A1 | 10/2011 |
| WO | WO 2011/123284 | A1 | 10/2011 |
| WO | WO 2011/123606 | A1 | 10/2011 |
| WO | WO 2011/123733 | A1 | 10/2011 |

OTHER PUBLICATIONS

International Preliminary Report on Patentability for PCT/US2009/000727 completed Mar. 24, 2010.
English language abstract for EP 0 421 146 A2, (Apr. 1991).
English language abstract for EP 1 323 817 A1, (Jul. 2003).
Price-Jones, et al., "*N,N'*-ethylenediyl-*bis*-alkanamides: Differential scanning calorimetry studies,"*J. Am. Oil Chem. Soc*. 73:311-319 (1996).
English language abstract for DE 24 30 140 A1, (2011).
English language abstract for DE 34 02 146 A1, (2011).
English language abstract for DE 36 08 093 A1, (2011).
English language abstract for EP 1 018 541 A1, (2001).
English language abstract for WO2009/018955 A2, Aug. 2011.
Second English language abstract for WO2009/018955 A2.
Product Advertisement for Tetranyl AO-1, http//kaochemicals-eu.com/213.html, downloaded Jul. 27, 2011.
U.S. Appl. No. 13/072,701, filed Mar. 26, 2011, Köhle.
U.S. Appl. No. 13/072,703, filed Mar. 26, 2011, Köhle.
English language translation of CS 246532, listed as document B2 above, (Mar. 1986).
English language abstract for DE 197 08 133, listed as document B3 above, (2012).
English language abstract for EP 0 284 036, listed as document B4 above, (2012).
English language abstract for WO 91/01295, listed as document B7 above, (2012).
English language abstract for WO 94/14935, listed as document B9 above, (2012).
English language abstract for WO 2007/125005, listed as document B10 above, (2012).
Ullman's Encyclopedia of Industrial Chemistry; Wiley-VCH Verlag GmbH & Co. KGaA, Weinheim, vol. 14, Table 2, p. 77 (2012).
Office Action mailed Oct. 2, 2012 for co-pending U.S. Appl. No. 13/603,000.
Preliminary Amendment filed for copending U.S. Appl. No. 13/643,486 on Oct. 25, 2012.
U.S. Appl. No. 13/603,000, filed Sep. 4, 2012, Nagy.
U.S. Appl. No. 13/643,486, filed Oct. 25, 2012, Köhle.

* cited by examiner

RINSE AID COMPOSITIONS WITH IMPROVED CHARACTERISTICS

FIELD OF THE INVENTION

The present invention relates to compositions, preferably microemulsions, that contain esterified dialkyldiethanolammonium quaternary compounds, hydrophobes and optionally water. The compositions may be used as rinse aids to facilitate drying of hard surfaces and will be especially useful in automatic car washes.

BACKGROUND OF THE INVENTION

Rinse aid agents are applied in automatic car washes to promote the drying of wet surfaces after a vehicle is cleaned. Such compositions typically contain a hydrophobic substance, a cationic emulsifier (e.g., a dialkyl dimethyl quaternary ammonium compound, or imidazoline quaternary surfactant), solvents (usually glycol ethers and/or alcohols) and, optionally, coemulsifiers (mostly nonionic or amphoteric surfactants such as alcohol ethoxylates, amine ethoxylates, betaines, etc.). During washing of a vehicle, the use of surface-active agents in the washing water results in the formation of a continuous, firmly adhering film of water on the vehicle surface. This film has to be removed to promote drying and to avoid the formation of spots or streaks due to the presence of salts and other impurities in the water. To achieve this, surface-active quaternary ammonium compounds and hydrophobes are added to the water in the rinsing phase. Because of the adsorption of the cationic surfactant and the hydrophobe on the paint surface, the water film is opened up, and the drops of water can then easily be removed by means of a blower.

Many of the ingredients typically used in rinse aids have undesirable environmental and performance characteristics, such as poor biodegradability or even toxicity, unpleasant smell, flammability, and high volatile organic compound (VOC) content. In addition, these compositions are often in the form of emulsions that may go through a viscous gel phase upon dilution. This makes them difficult to apply in automated carwash operations since they may plug spray nozzles and interfere with the proper operation of metering pumps.

US application Ser. Nos 2005/0014672 is directed to a rinse aid additive and to rinse aid compositions containing the additive. The additive includes: an amidoamine quaternary ammonium component derived from a non-animal source; a first primary amine ethoxylate derived from a non-animal source; and a second primary amine ethoxylate derived from an animal source.

U.S. Pat. No. 6,235,914, U.S. Pat. No. 6,376,455 and U.S. Pat. No. 6,458,343 relate to quaternary ammonium compounds and formulations thereof that are useful as cleaning compositions, antistatic compounds, paper debonders, fabric softeners, hair conditioners, skin conditioners, paper deinking and ink floatation agents, asphalt emulsion agents, corrosion inhibitor agents, ore floatation agents, pesticide emulsion agents, car drying aid sprays, drilling fluid additives, and the like.

U.S. Pat. No. 5,703,029 is directed to a water-dilutable car drybright compositions which have a strong hydrophobicizing action and which are used in rinsing liquids at carwash installations. The disclosed compositions contain ester quats which are the reaction products of alkanolamines and fatty acids, a fatty amine coemulsifier and a glycol ether solvent.

U.S. Pat. No. 6,255,274 relates to soil release polymers in detergents, cleaning agents and fabric softeners. The latter may contain ester quats which are the reaction products of alkanolamines and fatty acids and further quaternized with customary alkylating or hydroxyalkylating agents. Triethanolamine and methyl diethanolamine type ester quaternaries are particularly preferred.

EP 1 323 817 B1 discloses cationic preparations for cleaning hard surfaces, that contain esterquats with acyl groups derived from unsaturated $C_8$-$C_{22}$ fatty acids with iodine values of 100 to 150 as cationic surfactants.

EP 1 840 197 A1 relates to a composition for rinsing and drying vehicles comprising at least one addition salt of an ester amine. The comparative examples disclose compositions comprising a triethanolamine oleic acid ester quat, a hydrophobe, an ethoxylated amine coemulsifier and a butyl glycol solvent.

U.S. Pat. No. 5,827,451 discloses isotropic oil-in water microemulsions containing an oil component of a fatty acid, fatty alcohol or ester thereof; a quaternary ammonium component; an ether component; and water. The microemulsions may be used to form hydrophobic films on hard surfaces, rendering them useful in carwashes.

EP 0 421 146 discloses biodegradable compositions that can be used as drying agents for paint surfaces. The compositions contain a cationic surfactant, an emulsifier, a solvent and an oily component.

U.S. Pat. No. 5,391,325 discloses compositions for rinsing and drying vehicles comprising a cationic emulsifier, a fatty acid ester of an alcohol having 1 to 5 carbon atoms and a solubilizer, which can be a glycol ether solvent or an amine oxide.

Although the prior art discloses compositions that are useful as rinse aids, known compositions containing biodegradable emulsifiers usually provide emulsions of inferior stability and are less efficient as rinse aids. Therefore, there is still a need for rinse aid compositions with biodegradable components that form stable emulsions and impart hard surfaces with a durable hydrophobic coating that promotes short drying times at low use concentrations. In addition, it would be highly desirable if these compositions do not form gels during dilution.

SUMMARY OF THE INVENTION

The present invention is based upon the development of rinse aid compositions that exhibit improved biodegradability and high durability and drying kinetics on hard surfaces. The compositions form stable emulsions, preferably microemulsions, requiring less solvent and coemulsifiers than the prior art compositions. The compositions of the invention can be diluted with water to diluted emulsions that may be sprayed onto hard surfaces such as automobiles without the formation of viscous gels. The rinse aids contain a cationic emulsifier that sticks to hard surfaces and uniformly plates out the emulsified hydrophobe to create a shiny, hydrophobic coating which "sheets" the water away, or beads it up into droplets that can easily be removed by blowers. These characteristics make the rinse aids especially well suited for use in automatic carwashes.

In its first aspect, the invention is directed to a rinse aid composition which contains, at a minimum, an emulsifier and a hydrophobe. The emulsifier comprises two components: at least one ester quaternary of formula A containing two ester groups:

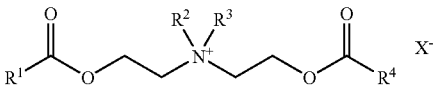

(A)

and at least one ester quaternary of formula B containing one ester group:

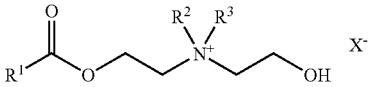

(B)

For both components A and B, $R^1$ and $R^4$ are each independently a $C_7$-$C_{21}$, alkyl or alkenyl; $R^2$ and $R^3$ are each independently a $C_1$-$C_6$ alkyl; and X— is an organic or inorganic anion.

The composition may further comprise water in the form of an emulsion, preferably a microemulsion. Apart from these components, the rinse aid compositions may also optionally include organic solvents and/or coemulsifiers.

In another aspect, the invention is directed to a method of treating a hard surface to reduce water wetting of said surface by applying an aqueous emulsion of the composition of the invention.

DETAILED DESCRIPTION OF THE INVENTION

The rinse aid compositions of the present invention contain a diethanolamine (DEA) based ester quaternary emulsifier and a hydrophobe. The emulsifier comprises two components, at least one diester quaternary of formula A shown above containing two ester groups and at least one monoester quaternary of formula B shown above containing one ester group.

The groups $R^1$ and $R^4$ in formulae A and B are each independently a $C_7$-$C_{21}$ alkyl or alkenyl group. The preferred groups for $R^1$ and $R^4$ are linear $C_{11}$-$C_{17}$ alkyl or alkenyl groups. Preferably, groups $R^1$ and $R^4$ are alkyl or alkenyl groups of fatty acids and may be mixtures of alkyl groups within the claimed range derived from fatty acids of natural origin. The most preferred groups for $R^1$ and $R^4$ are alkyl or alkenyl groups of coco fatty acid or canola fatty acid. The diester quaternary component of formula A constitutes preferably at least 60 weight percent (wt %) of the emulsifier, i.e. of the total amount of compounds of formulae A and B. Higher percentages of diester quaternaries of formula A of greater than 70 wt %, especially greater than 80 wt % are even more preferred. The emulsifier preferably comprises up to 99.9 wt % of diester quaternaries of formula A. The higher the diester quaternary content of the emulsifier, the better its emulsification power.

The groups $R^2$ and $R^3$ in formulae A and B are each independently a $C_1$-$C_6$ alkyl group. Preferably, at least one of them is methyl and most preferably, both $R^2$ and $R^3$ are methyl.

$X^-$ is an organic or inorganic anion, preferably a monovalent anion. Suitable inorganic anions that can be used include $Br^-$; $Cl^-$; $F^-$; $NO_3^-$; $PO_4^{3-}$; $HPO_4^{2-}$; $H_2PO_4^-$ and $SO_4^{2-}$. Suitable organic anions include $CH_3OSO_3^-$; $C_2H_5OSO_3^-$; $(CH_3O)_2PO_2^-$; acetate and formate.

Examples of specific diester quaternaries of formula A are: tallow diethyl ester dimethyl ammonium methyl chloride; coco diethyl ester dimethyl ammonium methyl chloride; coco diethyl ester dimethyl ammonium methosulfate; and canola diethyl ester dimethyl ammonium methosulfate.

The emulsifiers of the invention can be prepared by methods known from the prior art. A suitable way of preparing the emulsifier is by reacting an alkyldiethanolamine with a fatty acid to form a mixture of the alkyldiethanolamine monoester and diester. This mixture is then quaternized with an alkylating agent, such as dimethylsulfate or methylchloride.

As used herein, the term "hydrophobe" refers to a compound that is insoluble or only sparingly soluble in water, has a low volatility and does not act as a surfactant in aqueous mixtures. The solubility of the hydrophobe in water is preferably less than 0.1 g/l and the vapor pressure of the hydrophobe is preferably less than 0.2 mbar at 20° C. Mixtures of water and the hydrophobe preferably show a surface tension of the water phase at the water air interface that is at least 20% of the value of pure water. Suitable hydrophobes are mineral oils, for example mineral seal oil. Preferred hydrophobes are esters having a total carbon number of from 9 to 60 carbon atoms, more preferably esters of a monocarboxylic acid with a monohydric aliphatic alcohol. Most preferred are esters of a fatty acid or fatty acid mixture and an aliphatic alcohol having from 6 to 12 carbon atoms, in particular a branched chain alcohol. The esters are preferably biodegradable. In the context of this invention, the term "biodegradable ester" stands for an ester compound which shows an at least 70% dissolved organic carbon reduction in test C and an oxygen demand of at least 60% of the theoretical value in test E of OECD guideline 301 for biodegradability. Examples of most preferred hydrophobes are isooctyl laurate, isooctyl palmitate and isooctyl stearate.

The weight ratio of hydrophobe to emulsifier in the rinse aid composition is preferably 0.01 to 100, more preferably 0.1 to 10 and most preferably, 0.5 to 2.0.

The rinse aid compositions of the present invention preferably further contain water in addition to the emulsifier and the hydrophobe and are emulsions, preferably oil in water emulsions. The emulsions preferably contain 1 to 40 wt % emulsifier, 1 to 40 wt % hydrophobe and 20 to 98 wt % water. Most preferred are oil in water microemulsions. Microemulsions are thermodynamically stable emulsions having a droplet size of the dispersed phase smaller than the wavelength of visible light. Due to the small droplet size, such microemulsions are translucent or transparent. There are several reasons why microemulsions are preferred. Smaller droplets can be more evenly distributed on a surface upon application and will therefore create a more uniform, aesthetic, continuous surface covering. Oil in water microemulsions are stable, transparent or translucent, and maintain the properties of both the oil (hydrophobicity) and the water phase (dilutability). In addition, microemulsions have a high emulsifier/oil ratio compared to regular emulsions and this contributes to an enhanced hydrophobic effect.

Apart from the components described above, the rinse aid compositions may also optionally include organic solvents and/or coemulsifiers.

Typically, the weight ratio of organic solvent to emulsifier will be from 0.05 to 1.0 and the solvent will constitute from 1 to 10 wt % of the composition. Suitable solvents include glycols, glycol ethers, alcohols and their derivatives. Preferred solvents are short chain alcohols, most preferably isopropanol.

Coemulsifiers will typically constitute from 1 to 10 wt % of the composition and be present at a weight ratio of coemulsifier to emulsifier of from 0.05 to 1.0. Suitable coemulsifiers are nonionic or amphoteric surfactants. Preferred coemulsifiers are fatty amine ethoxylates and fatty alcohol ethoxylates.

In a particularly preferred aspect of the invention, the rinse aid compositions are made with biodegradable ester oil hydrophobes and environmentally friendly solvents and coemulsifiers to provide a completely biodegradable composition.

Many other additives may also be included in compositions and may be desirable for certain applications. Examples of other additives include dyes, colorants, optical brighteners, UV absorbers, pearlizing agents, fragrances, odor neutralizers, preservatives, water softeners, chelating agents, stabilizers, antimicrobial agents, pH control agents, viscosity modifiers, soil release agents, suds control agents and foaming agents.

The rinse aid compositions of the present invention can be prepared by blending all the ingredients except water together until homogeneous. Water is then added to the blend under intensive stirring. The clarity of the formed emulsion is an indicator of its stability with microemulsions being essentially transparent. The compositions should be clear, stable, non-viscous and readily dilutable by water.

In another aspect, the invention is directed to a method of treating a surface to reduce water wetting of the surface by applying an aqueous emulsion of any of the compositions described above to the surface. The emulsion applied to the surface is preferably made by diluting a composition as described above with water, preferably with 10 to 10000 parts by weight water and most preferably with 100 to 1000 parts by weight water to form the final rinse composition. Due to the emulsifier's cationic nature, the oil droplets of the emulsion will stick to the surface and uniformly plate out and anchor the emulsified hydrophobe to create a shiny, hydrophobic protective film which will allow the surface to "sheet" the water away, or bead it up into droplets which can easily be removed by blowers.

The aqueous emulsion, i.e. the final rinse composition, may be sprayed onto the surface of a vehicle as part of an automated carwash procedure. This would usually be done by spraying the aqueous emulsion onto the wet surface after the vehicle has been washed with detergents and would serve to promote drying and leave a durable shiny coating on the vehicle for an improved appearance.

The rinse aid compositions of the invention are readily dilutable either before application or at the point of application without the formation of viscous gels. This allows dosing of the composition by injecting a predetermined amount into a rinse water delivery pipe at an automated car wash. Once diluted, the compositions may be pumped through spray nozzles and onto wet surfaces of vehicles that were cleaned in previous steps. Once applied, the emulsion quickly penetrates through the water film and the positively charged cationic emulsifier electrostatically adheres to the negatively charged vehicle surface. The emulsified hydrophobe then evenly plates out on the car surface and disrupts the continuity of the water film by creating dry "islands" on the surface. The remainder of the water is either "pushed away" in continuous "sheets" (sheeting) or beaded up into droplets (beading) and can be easily removed with high velocity air blowers. The result is a dry, shiny surface with a protective coating. This protective film will eventually be washed off as the result of multiple rainfalls or with the next carwash operation and will ultimately end up in waste water treatment plants or in the environment (rivers, lakes, etc.). Thus, the biodegradability and environmental profile of the rinse aids offer a significant advantage.

It was found that the rinse aid compositions of the invention exhibit good stability and outperform rinse aids containing triethanolamine ester quaternary emulsifiers with respect to both durability and drying kinetics, i.e., the rinse aids of the invention promote shorter drying times and form a hydrophobic coating on vehicles that lasts longer. When compared to triethanolamine ester quaternary emulsifiers, the rinse aid compositions of the invention form stable emulsions containing a larger proportion of hydrophobe or a smaller proportion of solvent or coemulsifier and therefore can provide the desired hydrophobing effect on a hard surface with a lower amount of chemicals.

A high amount of diester quaternary component improves the stability of emulsions formed from the compositions of the invention and water and allows the preparation of stable emulsions from compositions having a higher content of hydrophobe. It also provides a further improvement in the rinse aid performance regarding durability and drying kinetics.

EXAMPLES

A. Nomenclature

Coco DADMAC is dialkyl dimethylammonium chloride with alkyl groups derived from coco fatty acid.

Coco DEEDMAC is a diacyloxyethyl dimethylammonium chloride prepared from coco fatty acid and methyldiethanolamine in a molar ratio of 1.8:1.

Coco DEEDMAMS is a diacyloxyethyl dimethylammonium methylsulfate prepared from coco fatty acid and methyldiethanolamine in a molar ratio of 1.8:1.

Canola DEEDMAMS is a diacyloxyethyl dimethylammonium methylsulfate prepared from canola fatty acid and methyldiethanolamine in a molar ratio of 1.8:1.

Canola TEEMAMS is a diacyloxyethyl hydroxyethyl methylammonium methylsulfate prepared from canola fatty acid and triethanolamine in a molar ratio of 1.78:1.

DPnB is dipropylene glycol n-butylether.

Mineral seal oil is an aliphatic petroleum naphtha middle distillate.

TMPDEO is ethoxylated 2,2,4-Trimethyl-1,3-pentanediol.

Deceth 4 is a $C_{10}$ fatty alcohol ethoxylate (4EO).

B. Test Methods

Stability Testing

Initial stability tests were conducted by determining whether a microemulsion remained homogeneous and clear for at least 24 hours at 40° C., room temperature (RT), 5° C. and in freeze-thaw stability tests. The latter tests were conducted by maintaining a composition at −25° C. for 24 hours, and then letting the sample thaw to room temperature. A stable composition should return to a homogeneous state without any agitation or stirring.

Long term stability was determined by maintaining compositions for a period of 3 months at 40° C., room temperature and 5° C.

Performance Testing on Glass Surfaces

Glass was chosen to perform durability and drying kinetics testing. After thorough cleaning with detergents and solvents, the glass surfaces were dried and flame-treated. This was done to remove contaminants so that test results reflected only the performance of the various rinse aids and hydrophobic coatings investigated.

Durability

The durability of the hydrophobic film created by spraying a rinse aid composition diluted with 500 weight parts of water onto surfaces was determined by advancing dynamic contact angle measurements using the procedure described in U.S. Pat. No. 6,462,009 columns 5 to 6 and 9 to 10, incorporated herein by reference in its entirety. After a rinse aid-treated microscope cover glass is immersed in deionized water and pulled out, advancing and receding contact angles are determined for water droplets on the hydrophobic surface using a microbalance (Wilhelmy Plate Method). Repeated immersions/rinse cycles mimic multiple rainfalls. Higher contact angles are associated with more beading and a higher contact angle after multiple cycles is indicative of a coating with greater durability.

Drying Kinetics (Water Retention Improvement During Spraying)

In order to probe the water sheeting/beading properties (drying speed) of rinse aid compositions, a glass plate of 12 inch by 12 inch was thoroughly cleaned, dried, and flame treated. The glass plate was then attached to a balance tilted at an angle of 22.5 degrees from horizontal. The glass plate was sprayed with distilled water for 30 seconds with water flowing off the glass plate to the side of the balance. After the spraying, the weight gain of the wetted glass plate over the dry glass plate was recorded ($W_1$). A rinse aid composition diluted with 500 weight parts of water was then sprayed onto the glass plate for 10 seconds (mimicking a rinse aid application step in an automatic vehicle wash facility) and the weight gain of the wetted glass plate over the dry glass plate was again recorded ($W_2$). The water retention during spraying was calculated as a percentage of $W_2$ vs $W_1$, i.e. $W_2/W_1 \times 100\%$. Lower water retention is an indication of better water sheeting (higher water loss). A decrease in water retention reflects an improvement in drying speed and ultimately results in less spotting on the surface.

C. Preparation of Rinse Aid Compositions

Rinse aid compositions with compositions as shown in tables 1 and 2 were prepared by uniformly mixing all components except water and slowly adding water to the resulting mixtures with rapid stirring. Compositions C and E separated into two phases within a few minutes after the stirring was stopped. All other compositions provided stable microemulsions which passed the initial and long term stability test.

TABLE 1

Rinse aid compositions

| Ingredient | | Composition (amount of ingredient in wt %) | | | | | |
|---|---|---|---|---|---|---|---|
| Function | Name | A* | B | C* | D* | E* | F |
| Emulsifier | Coco DADMAC (79% in isopropanol) | 20.00 | | | 22.20 | | |
| Emulsifier | Coco DEEDMAMS (70% in DPnB) | | 20.00 | | | | 17.01 |
| Emulsifier | Canola TEEMAMS (75% in DPnB) | | | 38.45 | | 16.98 | |
| Hydrophobe | Mineral seal oil | 25.00 | 25.00 | 19.23 | | | |
| Hydrophobe | Isooctyl palmitate | | | | 22.20 | | |
| Hydrophobe | Isooctyl laurate | | | | | 17.98 | 17.99 |
| Solvent | Ethylene glycol n-butyl ether | 5.00 | 5.01 | 3.87 | 6.70 | | |
| Solvent | Decamethylcyclo-pentasiloxane | | | | | 2.04 | 2.00 |
| Solvent | TMPDEO | | | | | 7.59 | 7.60 |
| Coemulsifier | Ethoxylated tallow amine (5EO) | | | | 4.40 | | |
| pH Adjuster | Glycolic acid (70%) | | | | | 0.55 | 0.51 |
| Diluent | Deionized water | 50.00 | 49.99 | 38.45 | 44.50 | 54.87 | 54.89 |

*not according to the invention

TABLE 2

Rinse aid compositions

| Ingredient | | Composition (amount of ingredient in wt %) | | | | | |
|---|---|---|---|---|---|---|---|
| Function | Name | G* | H | I | J | K | L |
| Emulsifier | Canola TEEMAMS (75% in DPnB) | 14.40 | | | | | |
| Emulsifier | Coco DEEDMAMS (70% in DPnB) | | 14.42 | 20.00 | | | |
| Emulsifier | Coco DEEDMAC (80% in isopropanol) | | | | 20.01 | | |
| Emulsifier | Canola DEEDMAMS (80% in isopropanol) | | | | | 14.04 | 13.62 |
| Hydrophobe | Isooctyl laurate | 10.00 | 10.00 | 21.12 | 20.01 | 23.95 | 21.12 |
| Solvent | Ethylene glycol n-butyl ether | 7.60 | 7.61 | 6.00 | 6.01 | 8.00 | 8.10 |
| Solvent | Decamethylcyclo-pentasiloxane | 2.00 | 2.00 | | | | |

TABLE 2-continued

| Rinse aid compositions | | | | | | | |
|---|---|---|---|---|---|---|---|
| Ingredient | | Composition (amount of ingredient in wt %) | | | | | |
| Function | Name | G* | H | I | J | K | L |
| Coemulsifier | Deceth 4 | 3.00 | 3.01 | | | | 3.89 |
| Coemulsifier | Ethoxylated tallow amine (5EO) | | | 4.00 | 4.00 | 4.11 | |
| pH Adjuster | Glycolic acid (70%) | 0.52 | 0.51 | | | | |
| Diluent | Deionized water | 62.48 | 62.45 | 50.00 | 49.97 | 49.90 | 53.28 |

*not according to the invention

D. Results

The Rinse Aid compositions described in Tables 1 and 2 were tested for durability and drying kinetics and results are shown below in Tables 3 and 4. A high contact angle after multiple rinse cycles indicates high durability of the hydrophobic film created by the rinse aid composition when applied to rinse a hard surface. A decrease in water retention reflects an improvement in drying speed.

TABLE 3

| Durability of the hydrophobic film created by the rinse aid compositions | | | | | | | | | |
|---|---|---|---|---|---|---|---|---|---|
| Rinse | Advancing Contact Angles (Degree) | | | | | | | | |
| Cycle | A* | B | D* | F | G* | H | I | K | L |
| 1 | 93.2 | 87.5 | 90.0 | 94.4 | 78.4 | 94.3 | 94.2 | 88.2 | 90.4 |
| 2 | 88.0 | 84.4 | 88.4 | 94.8 | 77.6 | 93.8 | 91.5 | 85.8 | 84.0 |
| 3 | 86.6 | 83.0 | 87.1 | 93.4 | 76.1 | 94.4 | 91.4 | 85.6 | 81.8 |
| 4 | 85.8 | 83.3 | 87.5 | 93.5 | 73.5 | 92.9 | 91.2 | 84.5 | 80.8 |
| 5 | 85.2 | 82.9 | | 93.0 | 72.7 | 94.0 | 92.1 | 83.3 | 78.6 |
| 6 | 83.7 | 82.7 | 87.1 | 93.3 | 69.7 | 94.0 | 91.3 | 81.5 | 75.8 |
| 7 | 83.1 | 81.0 | 87.3 | 93.4 | 67.7 | 94.0 | 91.1 | 86.0 | 73.8 |
| 8 | 82.9 | 84.3 | 84.4 | 94.1 | 70.7 | 93.5 | 91.3 | 83.3 | 70.9 |
| 9 | 82.9 | 83.3 | | | 67.5 | 94.1 | 90.1 | 84.0 | 71.2 |
| 10 | 82.1 | 81.3 | | 93.9 | 69.9 | 93.8 | 89.7 | 80.6 | 67.7 |

*not according to the invention

TABLE 4

| Water retention in the drying kinetics test (single rinse) | | | | | | | | |
|---|---|---|---|---|---|---|---|---|
| | Composition | | | | | | | |
| | A* | B | D* | F | G* | H | I | K |
| Water retention in % | 77.6 | 88.5 | 80.3 | 80.6 | 94.0 | 69.1 | 77.5 | 77.3 |

*not according to the invention

Compositions A, B and C show that the claimed compositions can be formulated with a mineral oil hydrophobe in the same manner as prior art compositions containing a non-biodegradable dialkyldimethylammonium quat emulsifier, whereas the biodegradable TEA ester quat emulsifier known from the prior art did not form a stable emulsion with a mineral oil hydrophobe, even at a higher emulsifier to hydrophobe ratio. Compositions D, E and F demonstrate that the same is true for compositions formulated with a biodegradable ester oil hydrophobe at an emulsifier to hydrophobe weight ratio of 1:1. The TEA ester quat emulsifier did not form a stable emulsion in composition E, whereas composition F according to the invention was a stable microemulsion. The TEA ester quat emulsifier formed stable emulsions only for higher emulsifier to hydrophobe weight ratios such as a ratio of 1.4:1 in composition G. The claimed compositions have better emulsifying power and provide stable microemulsions with less emulsifiers, e.g. at an emulsifier to hydrophobe weight ratio of 1:1.7 as demonstrated by composition K. The high emulsifying power of the claimed compositions allows formulation of stable microemulsions without an ethylene glycol ether solvent and without a coemulsifier (composition F).

The claimed compositions containing an ester oil hydrophobe also provide improved drying kinetics and a superior durability of the rinse aid effect, both when compared to a traditional non-biodegradable dialkyldimethylammonium quat emulsifier (composition I versus D) or to a prior art TEA ester quat emulsifier (composition H versus G). These compositions allow formulation of fully biodegradable rinse aids with improved rinse aid efficiency.

All references cited herein are fully incorporated by reference. Having now fully described the invention, it will be understood by those of skill in the art that the invention may be practiced within a wide and equivalent range of conditions, parameters and the like, without affecting the spirit or scope of the invention or any embodiment thereof.

The invention claimed is:

1. A hard surface rinse aid composition for an automobile comprising:

a) an emulsifier comprising:

i) at least one compound of formula A:

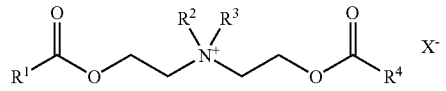

(A)

and ii) at least one compound of formula B:

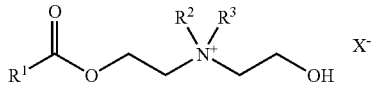

(B)

wherein for both compounds of formula A and B:

$R^1$ and $R^4$ are each independently a $C_7$-$C_{21}$ alkyl or alkenyl;

$R^2$ and $R^3$ are each independently a C1-C6 alkyl;

X is an organic or inorganic anion, and wherein the compounds of formula A constitute more than 70 wt % of the total amount of compounds of formulae A and B; and b) a hydrophobe, which is an ester of a monocarboxylic acid with a monohydric aliphatic alcohol, said ester having a total carbon number of from 9 to 60 carbon atoms, or a mineral oil;

wherein said composition further comprises water in the form of an emulsion; and wherein said composition, after dilution with water and upon contact with said surface uniformly plates out said hydrophobe on said surface.

2. The composition of claim 1, wherein $R^1$ and $R^4$ are each independently a linear $C_{11}$-$C_{17}$ alkyl or alkenyl group.

3. The composition of claim 1, wherein $R^1$ and $R^4$ are alkyl and alkenyl groups of fatty acids selected from the group of coco fatty acids and canola fatty acids.

4. The composition of claim 1, wherein $R^2$ and $R^3$ are $CH_3$.

5. The composition of claim 1, wherein the monocarboxylic acid is a fatty acid or fatty acid mixture and the alcohol is a branched chain aliphatic alcohol with from 6 to 12 carbon atoms.

6. The composition of claim 1, wherein the hydrophobe is a biodegradable ester.

7. The composition of claim 1, wherein the weight ratio of hydrophobe to emulsifier is 0.01-100.

8. The composition of claim 7, wherein the weight ratio of hydrophobe to emulsifier is 0.5-2.0.

9. The composition of claim 1, wherein said emulsion is an oil in water microemulsion.

10. The composition of claim 1, wherein said composition comprises 1-40 wt % emulsifier; 1-40 wt % hydrophobe; and 20-98 wt % water.

11. The composition of claim 1, wherein said composition further comprises 1-10 wt % of an organic solvent.

12. The composition of claim 11, wherein said solvent is selected from the group of glycols, glycol ethers, and alcohols.

13. The composition of claim 1, wherein said composition further comprises 1-10 wt % of a coemulsifier.

14. The composition of claim 13, wherein said coemulsifier is a nonionic or amphoteric surfactant.

* * * * *